US011267544B2

(12) United States Patent
Khanna

(10) Patent No.: US 11,267,544 B2
(45) Date of Patent: Mar. 8, 2022

(54) STABILIZATION SYSTEM FOR MARINE VESSELS

(71) Applicant: Honda Motor Co., Ltd., Tokyo (JP)

(72) Inventor: Rahul Khanna, Mountain View, CA (US)

(73) Assignee: HONDA MOTOR CO., LTD., Tokyo (JP)

( * ) Notice: Subject to any disclaimer, the term of this patent is extended or adjusted under 35 U.S.C. 154(b) by 29 days.

(21) Appl. No.: 16/821,520

(22) Filed: Mar. 17, 2020

(65) Prior Publication Data

US 2021/0291942 A1 Sep. 23, 2021

(51) Int. Cl.
*B63B 39/00* (2006.01)
*B63B 79/40* (2020.01)
*B63B 7/08* (2020.01)

(52) U.S. Cl.
CPC ..... *B63B 39/00* (2013.01); *B63B 7/082* (2013.01); *B63B 79/40* (2020.01); *B63B 2207/02* (2013.01)

(58) Field of Classification Search
CPC ..... B63B 39/00; B63B 79/40; B63B 7/082; B63B 2207/02
See application file for complete search history.

(56) References Cited

U.S. PATENT DOCUMENTS 3,221,831 A * 12/1965 Weiland ..... B63B 1/322 180/117
3,834,752 A * 9/1974 Cook ..... B60D 5/00 180/309
4,864,961 A * 9/1989 Slonski ..... B63B 43/14 114/360
6,526,900 B2 * 3/2003 Redman ..... B60F 3/0038 114/123
8,413,600 B2 4/2013 Kaye
10,245,937 B2 * 4/2019 Gillett ..... B60K 7/0007
2014/0150705 A1 6/2014 Wundt
2014/0290556 A1 10/2014 Desmarest
2015/0059635 A1 3/2015 Fritsch et al.

FOREIGN PATENT DOCUMENTS

CN 200981632 Y 11/2007
CN 202743436 U 2/2013
CN 204726636 U 10/2015
RU 2287449 C1 11/2006
RU 138845 U1 3/2014
WO 1991016232 A1 10/1991
WO 2018026289 A1 2/2018
(Continued)

OTHER PUBLICATIONS

Espacenet Machine Translation of Published CN Patent Application 200981632 Y, Issued Nov. 28, 2007.
(Continued)

*Primary Examiner* — Stephen P Avila
(74) *Attorney, Agent, or Firm* — Plumsea Law Group, LLC

(57) ABSTRACT

A stabilization system for a marine vessel includes at least two inflatable bladders configured to be attached to the marine vessel, a gyroscopic sensor configured to sense an angular orientation of the marine vessel, and a controller configured for inflating and deflating the at least two inflatable bladders responsive to the angular orientation sensed by the gyroscopic sensor.

12 Claims, 5 Drawing Sheets

(56) References Cited

FOREIGN PATENT DOCUMENTS

| | | | | | |
|---|---|---|---|---|---|
| WO | WO-2018042451 A | * | 3/2018 | ..... | B63B 1/36 |
| WO | 2018219909 A1 | | 12/2018 | | |

OTHER PUBLICATIONS

Espacenet Machine Translation of CN Patent 202743436 U, Issued Feb. 20, 2013.
Espacenet Machine Translation of CN Patent 204726636 U, Issued Oct. 28, 2015.
Espacenet Machine Translation of Abstract of RU Patent 138845 U1, Issued Mar. 27, 2014.
Espacenet Machine Translation of RU Patent 2287449 C1, Issued Nov. 20, 2006.
Espacenet Machine Translation of WO Published Application 2018219909 A1, Issued Dec. 6, 2018.

* cited by examiner

STABILIZATION SYSTEM FOR MARINE VESSELS

BACKGROUND

1. Field of the Disclosure

The present disclosure relates to a stabilization system for a marine vessel and, more particularly, to a stabilization system utilizing inflatable bladders for suppressing rolling motion of the marine vessel.

2. Description of Related Art

The roll axis of a boat is an imaginary line running horizontally along the length of a boat, through its center of gravity, and parallel to the waterline. Movements about the roll axis of a boat are felt as a rolling motion from side-to-side, i.e., a port-to-starboard tilting motion. These movements about the roll axis are considered troublesome and are one of the most common causes of motion sickness. On very small boats this is experienced immediately when passengers step off the dock onto the boat, as their weight causes a disturbing heel, and then rolling swaying, of the hull. Further, when tied to a dock or in a slip in relatively calm water, wakes from passing boats can cause unexpected and rapid rolling motions, which may cause the boat to hit against the dock.

In order to alleviate the rolling motion, stabilization or suppression devices have been designed to dampen the roll of a boat, but most are directed toward larger ships such as large motor yachts, offshore and commercial vessels and ships used in defense and security. The main reason for the limitations on the use of stabilization devices has been economic reasons. For instance, external fins are widely used roll suppression devices on ships. The fins can be activated by hydraulic or pneumatic mechanisms and respond to the output of motion sensing devices so as to keep the damping effect of the fin lift in phase with the roll velocity of the vessel. Fins are generally effective, however, when the vessel is underway since the passage of water over the fins is necessary in order for them to generate the damping lift.

There is thus a need in the art for a cost efficient stabilization system and method for suppressing the roll motion in smaller marine vessels both while underway and while at anchor.

SUMMARY

Pleasure boating in smaller boats, such as ski boats, cuddy cabins, and the like, can be a very enjoyable experience on water bodies such as bays, rivers, lakes, etc., but for individuals sensitive to motion sickness, this is not the case. The unpleasantness of motion sickness is further amplified when a sudden weather system is encountered during an otherwise calm day, bring with it increased swells and whitecaps. Hence, in order to suppress the roll motion encountered in smaller boats, a stabilization system can be attached to the smaller boats to attenuate rotation of the boat hull about the roll axis during normal cruising, in response to heightened sea state, and when at anchor. The stabilization system thus lessens the prospect of motion sickness in individuals prone to the same both on calm days or when sudden weather is confronted.

In one aspect, the disclosure provides a stabilization system for a marine vessel including at least two inflatable bladders configured to be attached to the marine vessel, a gyroscopic sensor configured to sense an angular orientation of the marine vessel, and a controller configured for inflating and deflating the at least two inflatable bladders responsive to the angular orientation sensed by the gyroscopic sensor.

A further aspect of the disclosure provides a marine vessel having at least one hull, a stabilization system for attenuating rotation of the at least one hull about at least one axis of the marine vessel, the stabilization system including at least two inflatable bladders, a gyroscopic unit for sensing rotation of the at least one hull, and a controller in communication with the gyroscopic unit. According to an exemplary embodiment of the disclosure, one of the at least two inflatable bladders is disposed along a first side of the hull and another of the at least two inflatable bladders is disposed along a second side of the hull. The controller is thus configured to inflate or deflate one or more of the at least two inflatable bladders in order to counteract the rotation of the at least one hull sensed by the gyroscopic unit.

A system and method for stabilization of a marine vessel includes providing a marine vessel having a hull with a stabilization system including at least one inflatable bladder on a first side of the hull and at least one inflatable bladder on a second side of the hull, providing a gyroscopic unit for measuring an angular rolling motion of the hull about an axis, the gyroscopic unit communicating the measured angular rolling motion to a controller, and inflating or deflating at least one of the inflatable bladder on the first side and the inflatable bladder on the second side based upon the measured angular rolling motion.

Other systems, methods, features and advantages of the disclosure will be, or will become, apparent to one of ordinary skill in the art upon examination of the following figures and detailed description. It is intended that all such additional systems, methods, features and advantages be included within this description and this summary, be within the scope of the disclosure, and be protected by the following claims.

BRIEF DESCRIPTION OF THE DRAWINGS

The disclosure can be better understood with reference to the following drawings and description. The components in the figures are not necessarily to scale, emphasis instead being placed upon illustrating the principles of the disclosure. Moreover, in the figures, like reference numerals designate corresponding parts throughout the different views.

DETAILED DESCRIPTION

Figure 1:
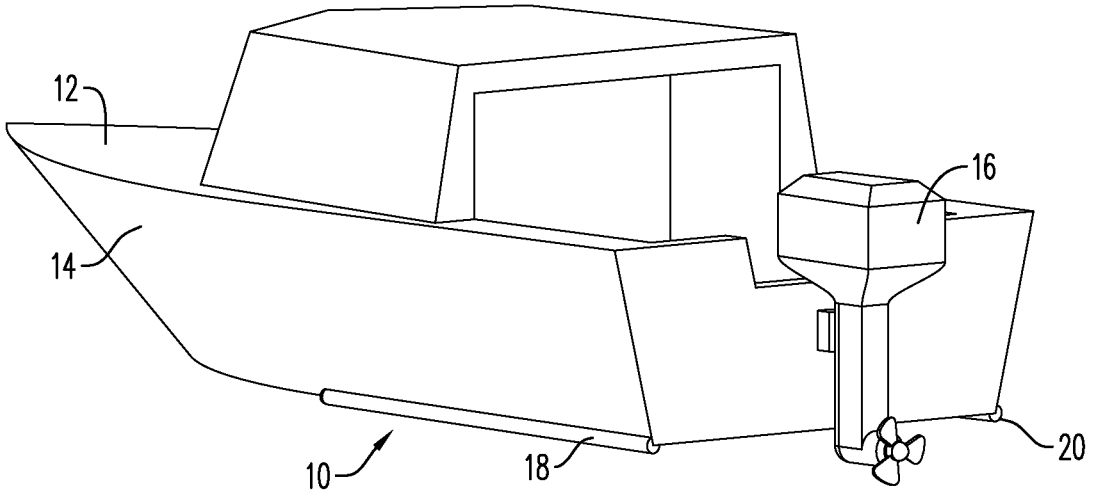
FIG. 1 is a rear perspective view of a marine vessel including a stabilization system, in a first state, in accordance with an exemplary embodiment of the disclosure.

Referring to FIGS. 1-4, an exemplary embodiment of a stabilization system for a marine vessel is shown generally by reference numeral 10. Stabilization system 10 is illustrated on a marine vessel 12 having a water engaging hull 14 and a motor 16. Marine vessel 12 is shown as a monohull-type boat, however, the stabilization system 10 could also be employed on boats having more than one hull, such as catamarans and the like. Marine vessel 12 is also shown as having a single motor 16 but one skilled in the art will appreciate that marine vessel 12 could have more than one motor and, rather than the outboard motor illustrated, the motor 16 could be an inboard engine or an inboard/outboard engine. The stabilization system 10 is best suited for pleasure marine vessels generally on the order of 10 to 25 feet in length, although outside of that range is also feasible. As explained in greater detail below, stabilization system 10 includes at least one inflatable bladder 18, 20 on each side of the marine vessel 12. The inflatable bladders 18, 20 are automatically activated, that is the inflation pressure is increased or decreased, in response to the motion of the vessel 12 when the stabilization system 10 is in use.

Figure 2:
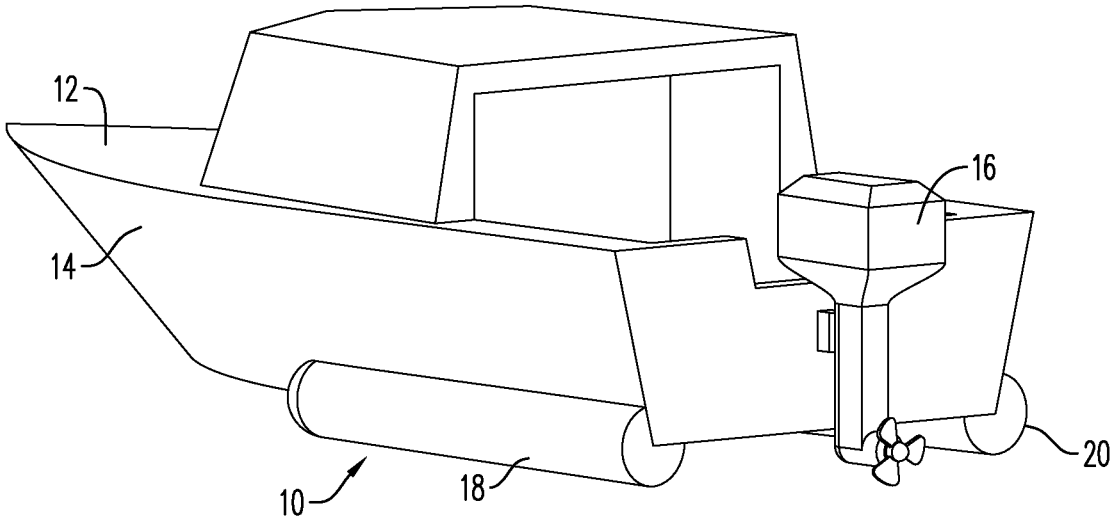
FIG. 2 is a rear perspective view of a marine vessel including a stabilization system, in a second state, in accordance with an exemplary embodiment of the disclosure.
Figure 3:
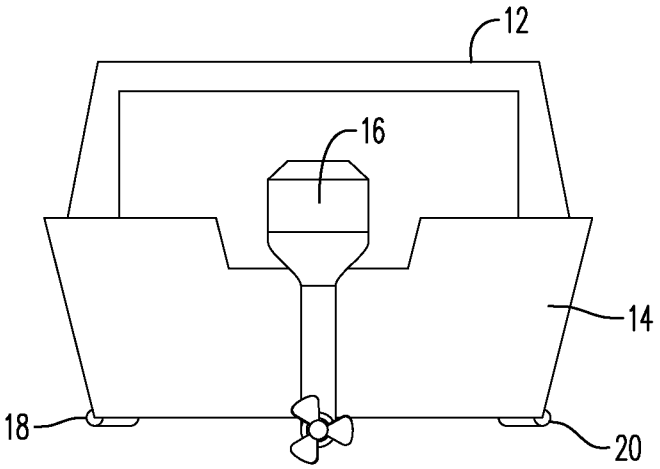
FIG. 3 is a rear view of the marine vessel shown in FIG. 1.
Figure 4:
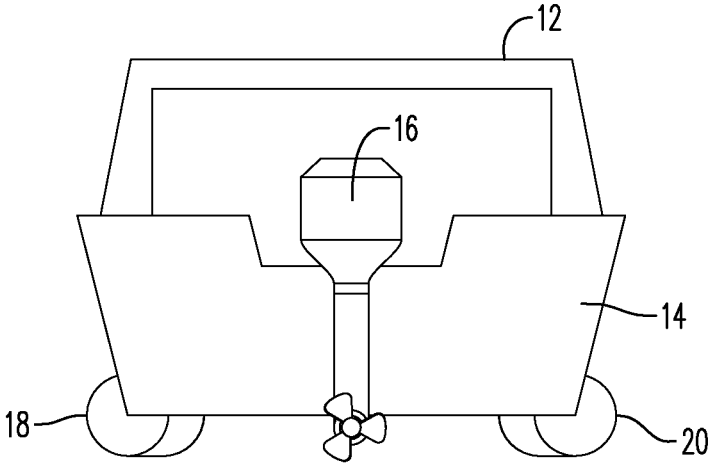
FIG. 4 is a rear view of the marine vessel shown in FIG. 2.

As shown in FIGS. 1 and 3, the bladders 18, 20 are fully deflated whereas in FIGS. 2 and 4 the bladders 18, 20 are fully inflated. The inflation and deflation of each bladder 18, 20 is controlled separately and independently based upon the motion of the vessel 12. More particularly, referring also to FIG. 5, a gyroscopic unit 22, such as a gyro sensor, is provided to sense the rotational motion or change in orientation of the vessel 12. Gyro sensors, also known as angular rate sensors or angular velocity sensors, are devices that sense angular velocity and are known in the art. In the stabilization system 10 of the disclosure here, the gyroscopic unit 22 communicates the sensed change in orientation to a controller 24, which inflates and/or deflates the inflatable bladders 18, 20 to counteract the change in orientation, i.e., rolling motion of the vessel 12, via a compressor 30, air tank or reservoir 26, and valves 26, 28.

Figure 5:
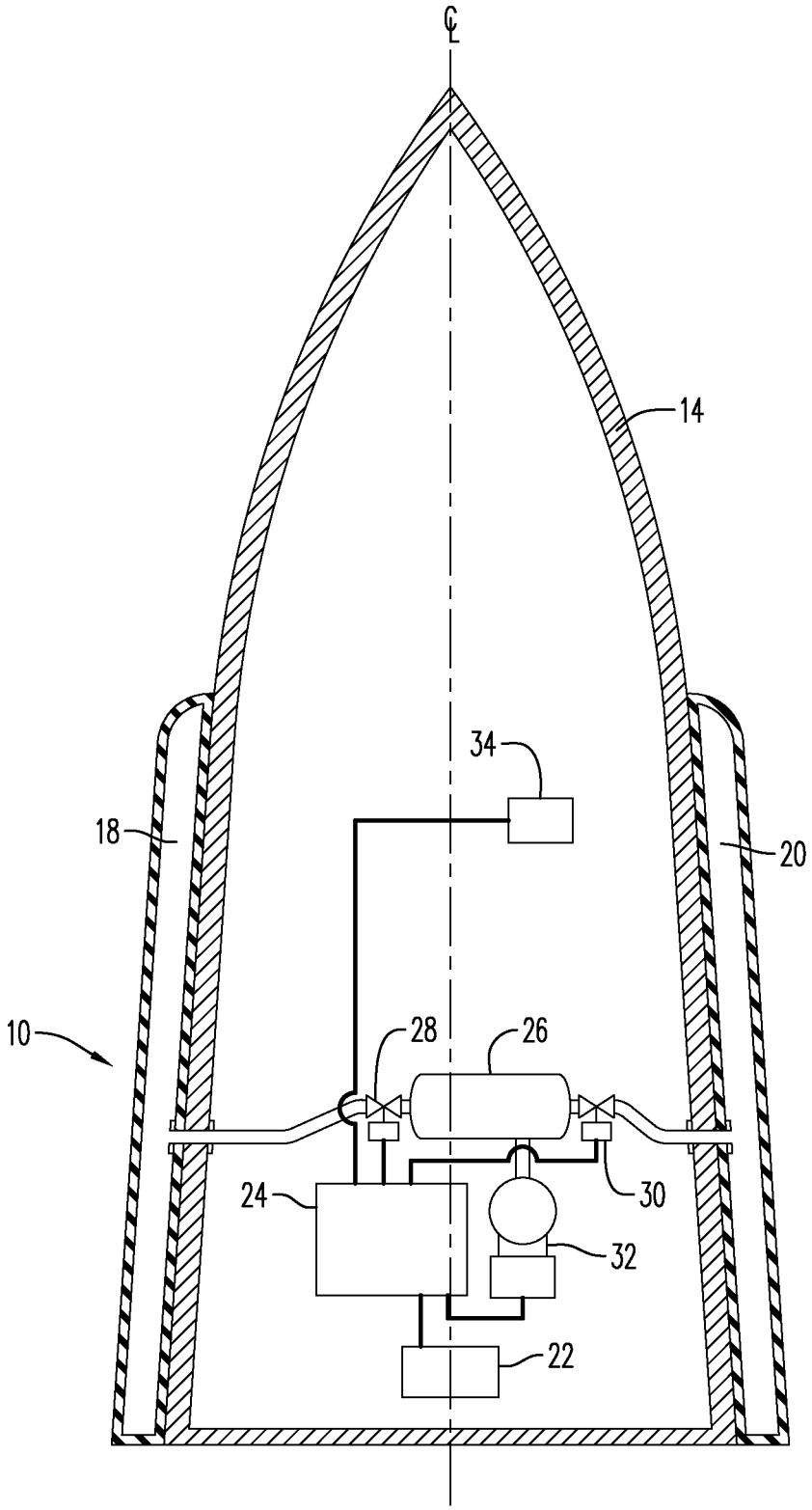
FIG. 5 is a schematic illustration of a control system for the stabilization system of a marine vessel according to an exemplary embodiment of the disclosure.
Figure 6A:
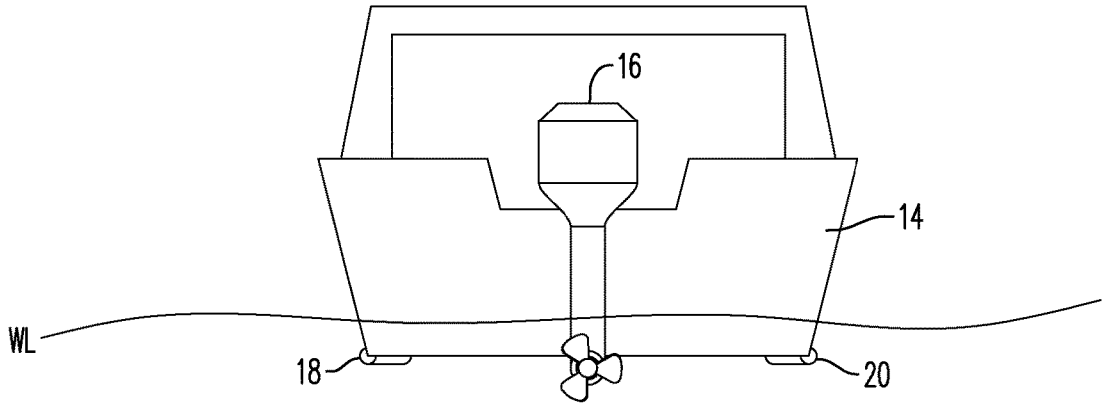
FIG. 6A-6C illustrate the use of a stabilization system for a marine vessel according to an exemplary embodiment of the disclosure under varying sea state conditions.
Figure 6B:
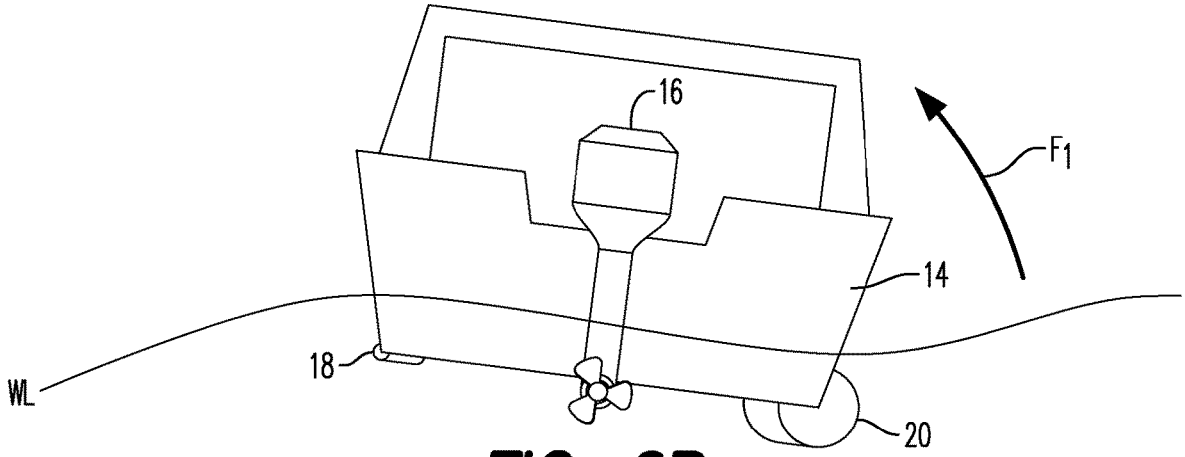
Figure 6C:
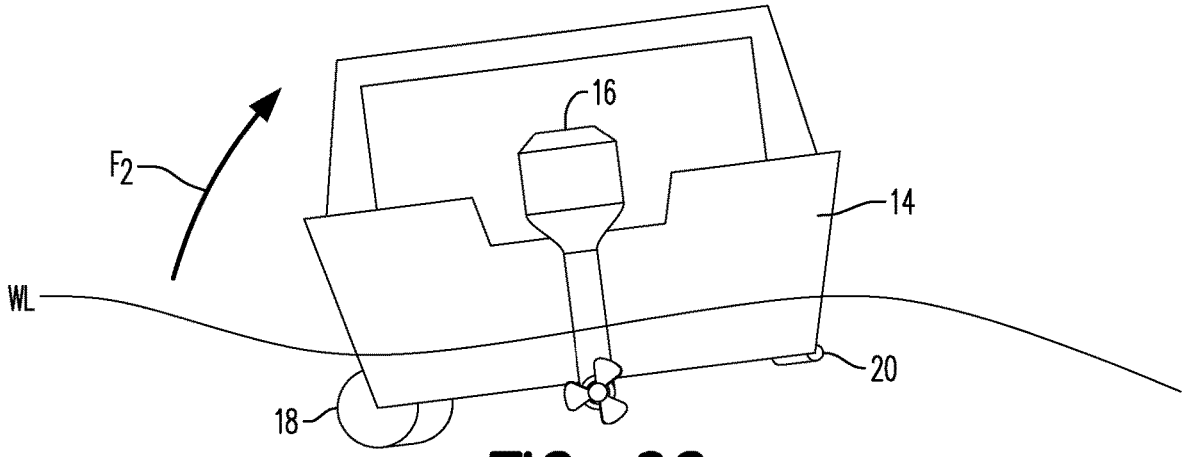

Referring also to FIGS. 6A-6C, the dynamic nature of stabilization system 10 is illustrated. In FIG. 6A, the marine vessel 12 is substantially level and the motor 16 is substantially perpendicular with the water line W. FIG. 6A demonstrates a fairly calm sea or, for instance, when the vessel 12 is docked and there are no disruptions influencing the sea state. In this condition, the vessel 12 maintains stability by way of its hull 14 and the stabilization system 10 is not actuated. Hence, both of the bladders 18, 20 are substantially deflated. FIG. 6B illustrates a sea swell that has caused the vessel to list to the starboard side (right side as illustrated). In response to this change in orientation, i.e., rotation about the roll axis of vessel 12, the starboard bladder 20 is inflated in order to provide a reactive force F1 to the rolling motion. The inflated starboard bladder 20 will thus reposition the vessel 12 in a more upright position while the port bladder 18 remains deflated. FIG. 6C illustrates the opposite rolling motion in that the port bladder 18 is inflated in order to compensate for the vessel 12 rolling to the port side (left side) thereof. In this instance the port bladder 18 creates a force F2 opposite to the rolling motion of the vessel about the roll axis of the vessel 12. The schematic drawings of FIGS. 6A-6C are simplified to illustrate the general operation principles of the stabilization system 10. In use, however, the bladders 18, 20 will be continuously inflated/deflated as needed and each may be partially inflated or deflated rather than fully inflated/deflated as shown in FIGS. 6A-6C. The gyroscopic unit 22 uses the Earth's gravity to determine orientation of the marine vessel 12 in an x-y-z coordinate system. A conventional mechanical gyroscope as known in the art includes a freely-rotating disk called a rotor, mounted onto a spinning axis in the center of a larger and more stable wheel. As the spin axis turns, the rotor remains stationary to indicate the central gravitational pull, and thus which way is "down" or vertical along the z-axis. In modern times, digital or electronic gyroscopic sensors operating on the same principles have replaced the mechanical devices of the past. As best shown in FIG. 5, the gyroscopic unit 22 is placed along the longitudinal centerline $C_L$ of the vessel 12, through its center of gravity, and parallel to the waterline $W_L$, that is, the gyroscopic unit 22 is placed along the roll axis (y-axis, $C_L$) of the marine vessel 12. In an upright, equilibrium state such as shown in FIG. 6A, the gyroscope 22 will measure zero. As the vessel 12 rolls, the gyroscope 22 will measure non-zero values corresponding to the heeling or tilting of the vessel 12 about the roll axis. The gyroscope 22 will communicate this non-zero value to the controller 24. In the case of FIG. 6B, the controller 24 will open or activate the starboard air control valve 30 in order to inflate the starboard bladder 20. Depending upon the previous roll state of the vessel 12, the controller 24 may also activate the port air control valve 28 in order to deflate or remove air from the port bladder 18. Hence, the valves 28, 30 in the exemplary embodiment of the disclosure are two-way (two-direction) air flow control valves that allow air to enter and leave the respective bladders. The valves 28, 30 may be single control valves which adjust airflow equally in both directions or, alternatively, they may be dual control valves which allow for independent control of airflow in each direction. A manually operable activation switch 34 is provided for activating and deactivating the stabilization system 10 either in the vicinity of the other system components or at the helm of the marine vessel 12.

In the exemplary embodiment of the disclosure, air is supplied to the air control valves 28, 30 from an air tank 26 or other reservoir suitable for holding pressurized air. The air tank 26 is pressurized by a compressor 32, such as an engine driven compressor. If required, a heat exchanger (not shown) may also be provided for cooling the engine driven compressor 32.

In addition to the information provided to the controller 24 by the gyroscopic unit 22, i.e., the non-zero value corresponding to the angular roll of the vessel 12, known information from other navigational components such as wind direction, wind speed, vessel speed, and the like may also be communicated to the controller 24 and utilized in formulation of the appropriate inflation/deflation response for each bladder 18, 20. Further, weather forecasts, sea state conditions, and other information may be communicated to the controller 24 in order to predictively inflate/deflate each bladder based upon the environment expected to be encountered. The inflatable bladders 18, 20 are formed from rubber or other expandable material capable of withstanding the inflation pressure within the bladders 18, 20. The particular material chosen and the thickness of the material will of course depend upon the intended maximum inflation pressure, which is based upon the size, weight and purpose of the marine vessel on which the bladders are being utilized. The bladders 18, 20 should be constructed from a light weight, durable material that can repeatedly expand and contract without failure or fatigue. According to the disclosure herein, the bladders 18, 20 are installed on the vessel 12 by gluing such as with an adhesive, or by ultrasonic welding, or any other type of attachment means that can attach the bladders 18, 20 to the hull 14 without degradation of the bladder material. Alternatively, a pocket made from a mesh or other water permeable material could be attached to the hull of the marine vessel, and the inflatable bladders could be removably retained within the pockets. When properly installed, the inflatable bladders 18, 20 are disposed below or at least partially below the surface of the water line $W_L$. Precise positioning of the inflatable bladders 18, 20 relative to the water line, i.e., positioning more or less of the bladder on the freeboard of the hull above the water line, is not required and will vary based upon the size and weight of the marine vessel 12.

Figure 7:
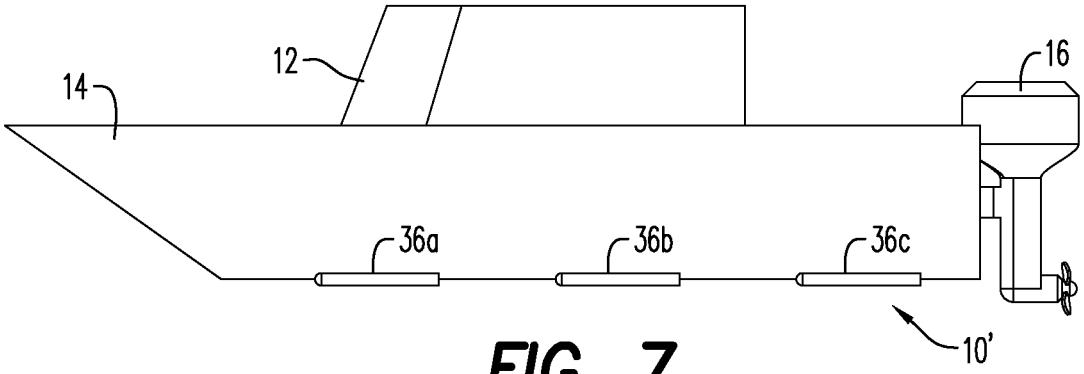
FIG. 7 is a side view of a marine vessel including a stabilization system according to a further exemplary embodiment of the disclosure.

Referring also to FIG. 7, a further exemplary embodiment of a stabilization system 10' is shown. In this embodiment, bladder 18 and/or bladder 20 are replaced by a plurality of smaller bladders along the hull 14 of the marine vessel 12. In the exemplary embodiment, three small bladders 36*a*, 36*b*, 36*c* are shown, but two or more could be used as well. The bladders 36*a*, 36*b*, 36*c* are interconnected such that a single air control valve 30, 32 may still be used to equally inflate or deflate the plurality of interconnected bladders 36*a*, 36*b*, 36*c*. Alternatively, each of the smaller bladders 36*a*, 36*b*, 36*c* may be provided with a separate air control valve such that each bladder is independently inflated or deflated based upon its location forward or aft (front and rearward) along the hull. In all other respect, the exemplary embodiment of FIG. 7 including a plurality of smaller bladders will operate in the same manner as the first exemplary embodiment described above relative to FIGS. 1-6.

Figure 8:
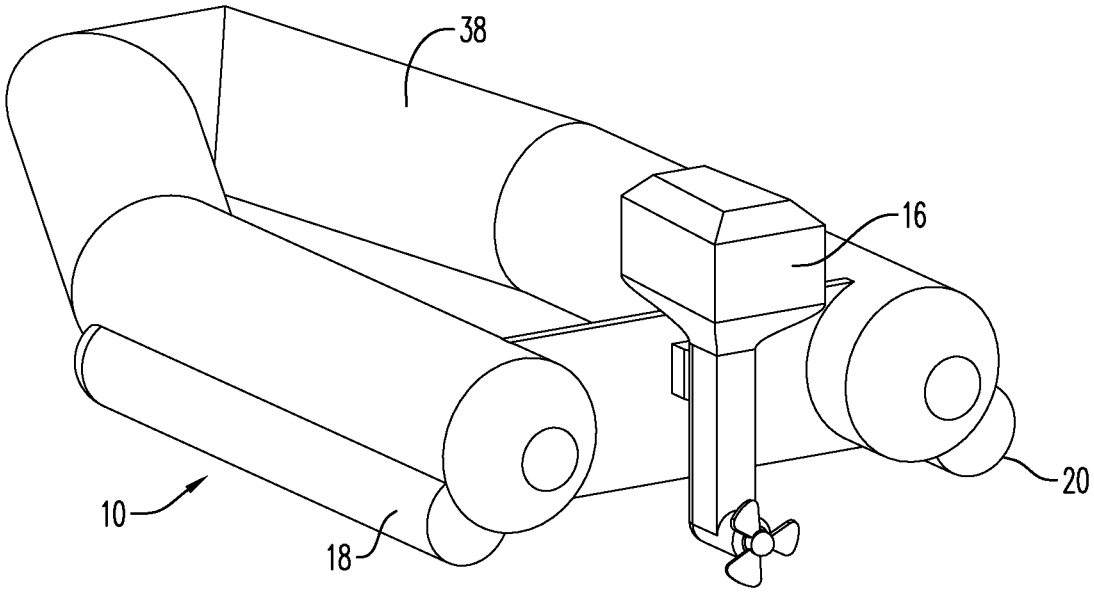
FIG. 8 is a rear perspective view of an inflatable marine vessel including a stabilization system in accordance with an exemplary embodiment of the disclosure.

Further, while stabilization 10, 10' is described above as being employed on monohull marine vessels and other boats having more than one hull, such as catamarans and the like, stabilization system 10, 10' could also be employed on an inflatable marine vessel 38 such as shown in FIG. 8. When used on an inflatable type boat 38, such as a dinghy or banana boat, the bladders 18, 20 would be separate and distinct inflatable chambers from the inflatable hull portion of the vessel 38.

While various embodiments of the disclosure have been described, the description is intended to be exemplary, rather than limiting and it will be apparent to those of ordinary skill in the art that many more embodiments and implementations are possible that are within the scope of the disclosure. Accordingly, the disclosure is not to be restricted except in light of the attached claims and their equivalents. Also, various modifications and changes may be made within the scope of the attached claims.

The invention claimed is:

1. A stabilization system for a marine vessel having a primary means of flotation, the stabilization system comprising:

at least two inflatable bladders configured to be attached to the marine vessel substantially at a surface of a water line such that the at least two inflatable bladders are disposed below or at least partially below the surface of the water line, the at least two inflatable bladders being separate and apart from the primary means of flotation;

a gyroscopic sensor configured to sense a non-zero angular orientation of the marine vessel; and a controller for inflating and deflating the at least two inflatable bladders responsive to the angular orientation sensed by the gyroscopic sensor when the marine vessel is underway and when the marine vessel is at rest.

2. The stabilization system according to claim 1, further comprising an air control valve for each of the at least two inflatable bladders, the controller configured to actuate the air control valve to inflate or deflate each of the at least two inflatable bladders.

3. The stabilization system according to claim 2, wherein each said air control valve comprises a two-way valve.

4. The stabilization system according to claim 2, further comprising an air tank and a compressor configured to supply compressed air to the air tank, the air tank connected to each of the air control valves.

5. The stabilization system according to claim 4, wherein the controller is configured to actuate the compressor to maintain a predetermined air pressure in the air tank.

6. The stabilization system according to claim 1, wherein each of said at least two inflatable bladders comprises a plurality of interconnected inflatable bladders.

7. The stabilization system according to claim 1, further comprising a manually operable activation switch for activating and deactivating the stabilization system.

8. A method for stabilization of a marine vessel comprising:

providing a marine vessel having a hull defining a primary means of full flotation for the marine vessel in water and a stabilization system, separate and apart from the primary means of floatation, including at least one inflatable bladder on a first side of the hull and at least one inflatable bladder on a second side of the hull;

providing a gyroscopic unit for measuring a non-zero angular rolling motion of the hull about an axis, the gyroscopic unit communicating the measured angular rolling motion to a controller; and inflating or deflating at least one of the inflatable bladder on the first side and the inflatable bladder on the second side based upon the measured angular rolling motion.

9. The method for stabilization of a marine vessel according to claim 8, further comprising inflating the at least one inflatable bladder on the first side of the hull when the marine vessel rolls in a direction towards the first side.

10. The method for stabilization of a marine vessel according to claim 9, further comprising inflating the at least one inflatable bladder on the second side of the hull when the marine vessel rolls in a direction toward the second side.

11. The method for stabilization of a marine vessel according to claim 8, further comprising providing an air control valve for each inflatable bladder, the controller actuating a respective air control valve for inflating or deflating the respective inflatable bladder.

12. The method for stabilization of a marine vessel according to claim 8, further comprising manually actuating an activation switch to activate or deactivate the stabilization system.

* * * * *